US009478901B2

(12) United States Patent
Chen et al.

(10) Patent No.: US 9,478,901 B2
(45) Date of Patent: Oct. 25, 2016

(54) ELECTRONIC PRODUCT AND ITS CABLE SET

(71) Applicant: Quanta Computer Inc., Taoyuan (TW)

(72) Inventors: Chun-Lung Chen, Taoyuan (TW); Ji-Dein Wu, Taoyuan (TW); Shih-Ling Huang, Miaoli County (TW); Yu-Feng Lin, Taoyuan (TW); Yen-Liang Liu, Taoyuan (TW); Ko-Chun Wang, Taoyuan (TW); Yu-Liang Chen, Taoyuan (TW); Chiung-Chang Tsai, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 0 days.

(21) Appl. No.: 14/729,855

(22) Filed: Jun. 3, 2015

(65) Prior Publication Data

US 2016/0261065 A1 Sep. 8, 2016

(30) Foreign Application Priority Data

Mar. 2, 2015 (TW) ..... 104203087 U

(51) Int. Cl.
*H01R 13/60* (2006.01)
*H01R 13/62* (2006.01)

(52) U.S. Cl.
CPC ..... *H01R 13/6205* (2013.01)

(58) Field of Classification Search
CPC ..... H01R 13/6205; H01R 13/641; H01R 13/7037
USPC ..... 439/40
See application file for complete search history.

(56) References Cited

U.S. PATENT DOCUMENTS 6,821,126 B2 * 11/2004 Neidlein ..... H01R 13/7037 439/38
7,351,066 B2 * 4/2008 DiFonzo ..... H01R 13/641 439/39
7,658,613 B1 * 2/2010 Griffin ..... H01R 13/6205 439/39
8,348,678 B2 * 1/2013 Hardisty ..... H01R 13/6205 439/39

* cited by examiner

*Primary Examiner* — Jean F Duverne
(74) *Attorney, Agent, or Firm* — Rabin & Berdo, P.C.

(57) ABSTRACT

An electronic product and its cable set are provided in which the cable set includes a cable assembly and a connector. The connector includes a single magnet block, a metal unit and two conductive ends. The metal unit is fixed and contacted with outer surfaces of the single magnet block, and is electrically connected to the cable assembly for attracting and electrically connecting to a portable electronic device. The conductive ends respectively penetrate through the single magnet block and electrically connect to the cable assembly for electrically connecting to the portable electronic device.

20 Claims, 4 Drawing Sheets

ELECTRONIC PRODUCT AND ITS CABLE SET

RELATED APPLICATIONS

This application claims priority to Taiwan Application Serial Number 104203087, filed Mar. 2, 2015, which is herein incorporated by reference.

BACKGROUND

1. Field of Disclosure

The present disclosure relates to an electronic product and its cable set.

2. Description of Related Art

Since peripheral products (e.g., wearable devices) of portable electronic devices (e.g., smart phones, tablet computers and notebook computers) are continually being innovated and introduced to the markets, and because the peripheral products are compact, users are able to conduct information exchange, social network communication and information access through the portable electronic devices by the peripheral products so as to further increase life quality and work efficiency. Therefore, since the peripheral products need electric power for continually conducting information exchange with the portable electronic devices, convenience of power charging to the peripheral products is therefore important.

Recently, a power charge system is commonly provided with an attaching mechanism, e.g., a USB connector, for tightly coupling a peripheral product to a cable set. However, the attaching mechanism needs to be reconsidered to improve the convenience of attaching or detaching the peripheral product from the cable set for usage intention.

Therefore, how to provide a solution to effectively solve the aforementioned inconvenience and shortages and to increase the competitiveness of industries shall be seriously concerned.

SUMMARY

One object of the disclosure is to provide an electronic product and its cable set to overcome the defects and inconvenience of the prior art.

To achieving the aforementioned object, according to one embodiment, an electronic product includes a portable electronic device and a cable set. The portable electronic device includes a working circuit and a connection interface. The connection interface includes a magnetic metallic member and two conductive members. The magnetic metallic member is electrically connected the working circuit. The conductive members are fixed on the magnetic metallic member, and respectively electrically connected the working circuit. The cable set includes a cable assembly and a connector. The cable assembly is electrically connected to an external device. The connector includes a single magnet block, a first metal unit and two conductive pins. The first metal unit is fixed and contacted with outer surfaces of the single magnet block, electrically connected to the cable assembly, separably magnetically-attracted the magnetic metallic member, and electrically connected to the magnetic metallic member. The conductive pins respectively penetrate through the single magnet block, are respectively electrically connected to the cable assembly, and separably electrically connect to the conductive members, respectively.

In the aforementioned embodiment of the disclosure, by the first metal unit magnetically attracting and holding the portable electronic device, the conductive pins are able to electrically connect to the corresponding terminals of the portable electronic device rapidly. Moreover, besides the conductive pins are electrically connected to the portable electronic device, the disclosure also utilizes the first metal unit for both electrical connecting to and magnetic attracting the portable electronic device. Thus, the convenience of attaching and detaching the portable electronic device from the cable set not only ca be increased, but also the whole sizes of the portable electronic device and the cable set can be effectively decreased.

In one or more embodiments, the conductive members and the magnetic metallic member respectively are a positive terminal, a negative terminal and a signal transmission terminal of the portable electronic device.

In one or more embodiments, the cable set further comprises a second metal unit. The second metal unit is arranged oppositely to the first metal unit, fixed and contacted with the outer surfaces of the single magnet block, and separably magnetically-attracted the magnetic metallic member.

In one or more embodiments, one surface of the first metal unit is a first magnetically attractive surface, one surface of the magnetic metallic member is a second magnetically attractive surface, and the first magnetically attractive surface is in direct contact with the second magnetically attractive surface.

In one or more embodiments, the first metal unit further comprises at least one first positioning portion, the first positioning portion is disposed on the first magnetically attractive surface, the magnetic metallic member comprises at least one second positioning portion, the second positioning portion is disposed on the second magnetically attractive surface, wherein the first positioning portion matches the second positioning portion for positioning the second positioning portion.

In one or more embodiments, the single magnet block comprises a block body and at least one through hole. The block body comprises at least one first surface and two second surfaces, which are opposite to each other, in which the first surface is disposed between the second surfaces, and the first surface surrounds and connects the second surfaces. The through hole penetrates through the second surfaces of the block body in which an inner surface of the through hole respectively connects the second surfaces, and the conductive pins are respectively disposed in the through hole.

In one or more embodiments, the single magnet block comprises a block body and at least one indentation. The block body comprises at least one first surface and two second surfaces, which are opposite to each other, in which the first surface is disposed between the second surfaces, and the first surface surrounds and connects the second surfaces. The indentation is formed on the block body, penetrates through the first surface and the second surfaces of the block body. An inner surface of the indentation respectively connects the first surface and the second surfaces of the block body, and the conductive pins are respectively disposed in the indentation.

In one or more embodiments, the cable set further comprising at least one insulating plastic layer. The insulating plastic layer is sandwiched between the single magnet block and one of the conductive pins.

In one or more embodiments, the first metal unit comprising a U-shaped clamping element and an accommodation recess. The U-shaped clamping element is fixed to clamp one end of the single magnet block. The accommodation recess is formed on the U-shaped clamping element for receiving the end of the single magnet block.

In one or more embodiments, each of the conductive pins is a pogo pin or a conductive pad.

In one or more embodiments, the first metal unit is a high magnetic permeability metal.

According to another embodiment, the cable set comprises a cable assembly and a connector. The cable assembly is electrically connected to an external device. The connector includes a single magnet block, a first metal unit and two conductive pins. The first metal unit is fixed and contacted with outer surfaces of the single magnet block, electrically connected to the cable assembly, and used for attracting and being electrically connected to a portable electronic device. The conductive pins respectively penetrate through the single magnet block, are respectively electrically connected to the cable assembly, and are used for being electrically connected to the portable electronic device.

In one or more embodiments, the conductive pins and the first metal unit respectively are a positive terminal, a negative terminal and a signal transmission terminal of the cable set.

It is to be understood that both the foregoing general description and the following detailed description are by examples, and are intended to provide further explanation of the disclosure as claimed.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure. In the drawings.

DESCRIPTION OF THE EMBODIMENTS

Figure 1:
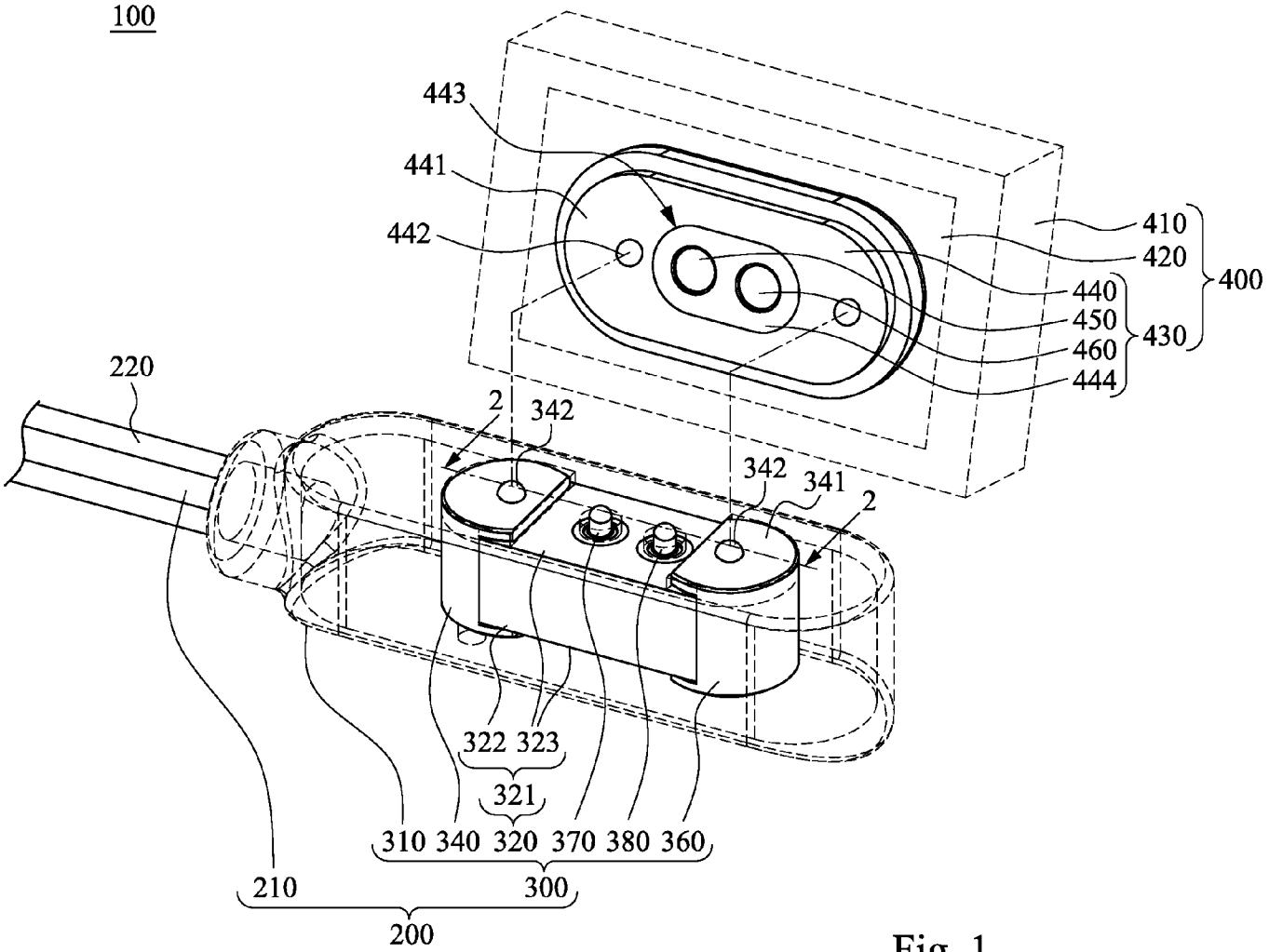
FIG. 1 is an exploded view of a portable electrical device and a cable set of an electronic product according to one embodiment of this disclosure.

Reference will now be made in detail to the present embodiments of the disclosure, examples of which are illustrated in the accompanying drawings. Wherever possible, the same reference numbers are used in the drawings and the description to refer to the same or like parts. According to the embodiments, it will be apparent to those skilled in the art that various modifications and variations can be made to the structure of the present disclosure without departing from the scope or spirit of the disclosure.

As used herein, "around," "about", or "approximately" shall generally mean within 20 percent, preferably within 10 percent, and more preferably within 5 percent of a given value or range. Numerical quantities given herein are approximate, meaning that the term "around," "about", or "approximately" can be inferred if not expressly stated.

Figure 2:
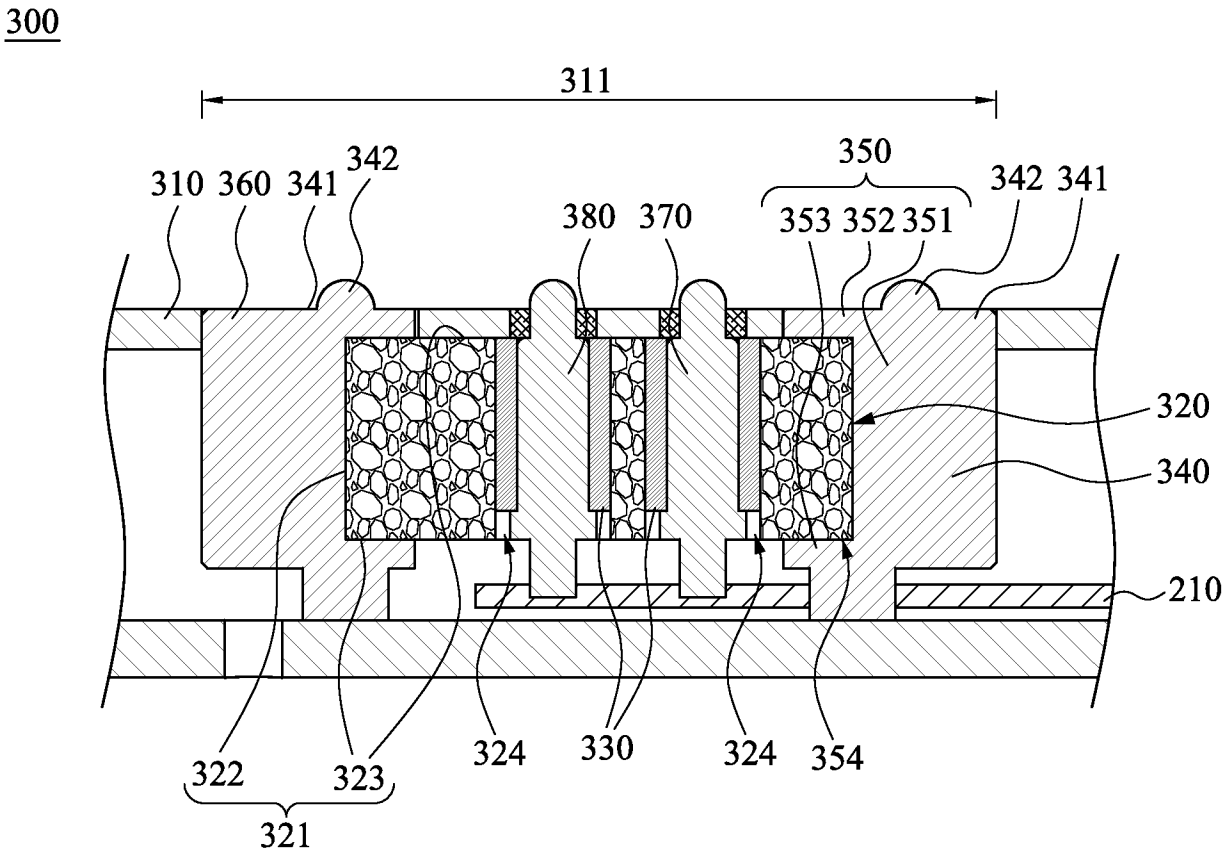
FIG. 2 is a cross sectional view of FIG. 1 taken along line 2-2.

FIG. 1 is an exploded view of a portable electrical device 400 and a cable set 200 of an electronic product 100 according to one embodiment of this disclosure, and FIG. 2 is a cross sectional view of FIG. 1 taken along line 2-2. As shown in FIG. 1 and FIG. 2, in the embodiment, the electronic product 100 includes a portable electronic device 400 and a cable set 200. The cable set 200 includes a cable assembly 210 and a charging cradle 300. One end of the cable assembly 210 is electrically connected to an external device (e.g., computer, not shown in figures), the other end of the cable assembly 210 is electrically connected to the charging cradle 300. The charging cradle 300 includes a first outer case 310, a single magnet block 320, a first metal unit 340, a second metal unit 360, a first conductive pin 370 and a second conductive pin 380, in which the single magnet block 320, the first metal unit 340, the second metal unit 360, the first conductive pin 370 and the second conductive pin 380 are all contained in the first outer case 310. The single magnet block 320 is a single-piece bipolar (N-S) magnet, and the single magnet block 320 in the cable set 200 of the embodiment is only one. The first metal unit 340 and the second metal unit 360 are physically separated, and the first metal unit 340 and the second metal unit 360 are respectively fixed and contacted with outer surfaces of two opposite ends (N-pole and S-pole) of the single magnet block 320. The first conductive pin 370 and the second conductive pin 380 are separated mutually and the first conductive pin 370 and the second conductive pin 380 respectively penetrate through the single magnet block 320. The cable assembly 210 is covered by a cable sheath 220, and one end of the cable assembly 210 is electrically connected to the first metal unit 340, the first conductive pin 370 and the second conductive pin 380 in the first outer case 310. Substantially, the cable assembly 210 includes wires (not shown in figures) bundled together in which the first metal unit 340, the first conductive pin 370 and the second conductive pin 380 are respectively electrically connected to one of the wires of the cable assembly 210, thus, the first metal unit 340, the first conductive pin 370 and the second conductive pin 380 are electrically isolated from one another. The charging cradle 300 is separably engaged with a connection interface of the portable electronic device 400. Thus, the external device is able to, for example, charge a battery (not shown) of the portable electronic device 400 via the cable set 200. However, the disclosure is not limited thereto, in other embodiments, the portable electronic device 400 also is able to exchange information with the external device mutually.

In the embodiment, specifically, the single magnet block 320 includes a block body 321 and two through holes 324. The block body 321 includes a first surface 322 and two second surfaces 323 which are opposite to each other in which the first surface 322 is disposed between the second surfaces 323, and the first surface 322 surrounds and connects to the second surfaces 323. The through holes 324 respectively penetrate through the second surfaces 323 of the block body 321. An inner surface of each of the through holes 324 respectively connects to the second surfaces 323 of the block body 321, and the first conductive pin 370 and the second conductive pin 380 are respectively disposed in the two through holes 324.

In the embodiment, for protecting and fixing the first conductive pin 370 and the second conductive pin 380 in the single magnet block 320, the charging cradle 300 further includes two insulating plastic layers 330. After each of the insulating plastic layers 330 is filled in one of the through holes 324, each of the insulating plastic layers 330 is sandwiched between the single magnet block 320 and one of the conductive pins (i.e., the first conductive pin 370 or the second conductive pin 380). Thus, the insulating plastic layers 330 not only can fix the first conductive pin 370 and the second conductive pin 380 in the through holes 324, but also are to avoid from degrading the conductive performance of the first conductive pin 370 and the second conductive pin 380 because the first conductive pin 370 and the second conductive pin 380 may be scratched and/or damaged by the single magnet block 320.

Also, in the embodiment, the first metal unit 340 includes a U-shaped clamping element 350. The U-shaped clamping element 350 is fixed to clamp one end (e.g., N-pole or S-pole) of the single magnet block 320. The U-shaped clamping element 350 includes a main body 351, a first extending rib 352 and a second extending rib 353, and an accommodation recess 354 is mutually defined by the main body 351, the first extending rib 352 and the second extending rib 353. The accommodation recess 354 receives the end of the single magnet block 350, and the main body 351, the first extending rib 352 and the second extending rib 353 directly contact with the end of the single magnet block 350. It is noted, since the profile of the second metal unit 360 is similar to the profile of the aforementioned first metal unit 340, the features of the second metal unit 360 will not be described again. However, regarding to the profiles of the second metal unit 360 and the first metal unit 340, the disclosure is not limited to the aforementioned features.

Although the first metal unit 340 and the second metal unit 360 oppositely arranged on two ends of the single magnet block 320 is described in the embodiment, however, the disclosure is not limited to the aforementioned features, in other embodiments, there might be only single one metal unit to be fixed on the single magnet block. Furthermore, the materials of the first metal unit and the second metal unit are not limited in the disclosure, preferably, the materials of the first metal unit and the second metal unit can be any kinds of metals (e.g., copper and iron) with both high magnetic permeability and low impedance characteristics.

Figure 3:
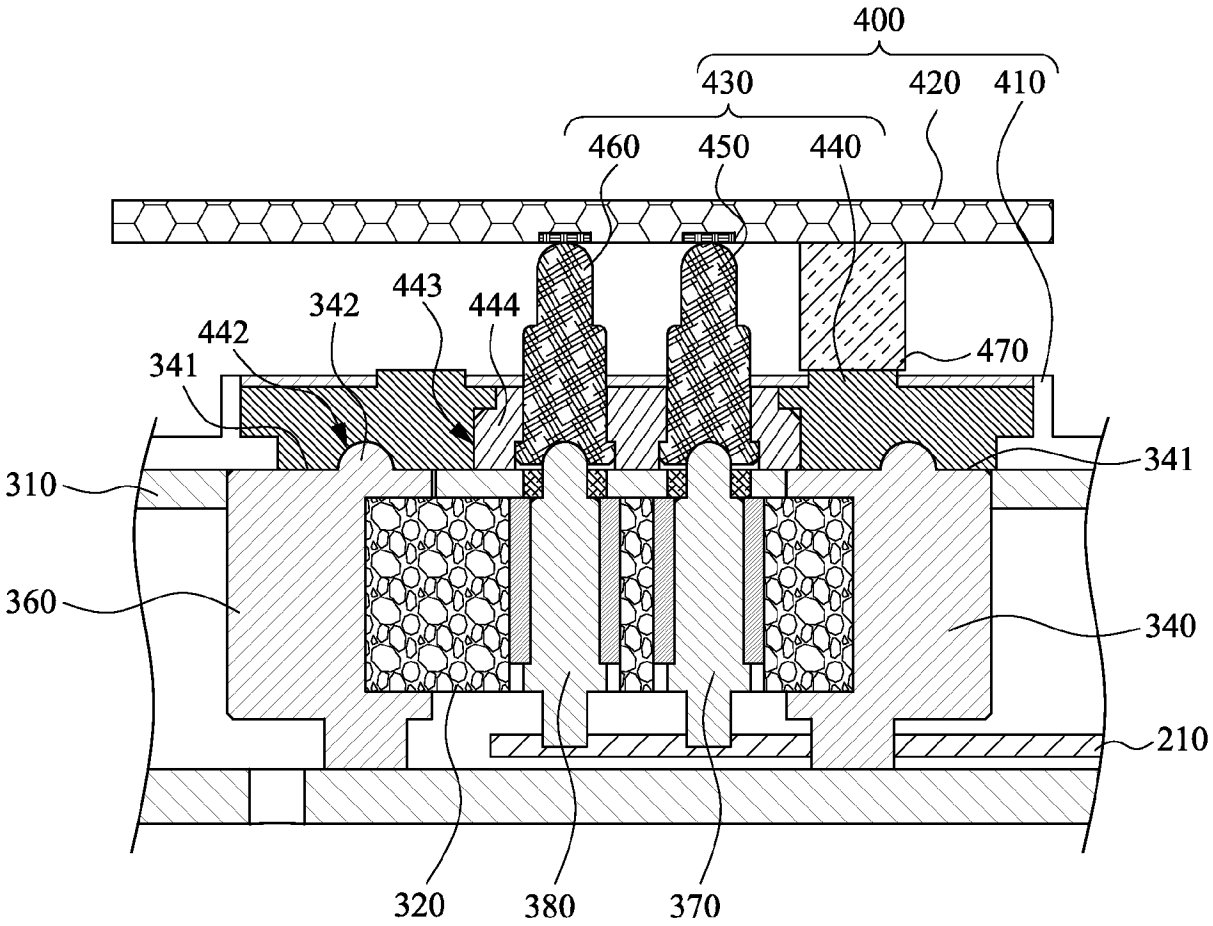
FIG. 3 is a cross sectional view of FIG. 1 as the portable electrical device and the cable set are engaged.

FIG. 3 is a cross sectional view of FIG. 1 as the portable electrical device 100 and the cable set 200 are engaged. As shown in FIG. 1 and FIG. 3, according to the embodiment, the portable electronic device 400 includes a second outer case 410, a working circuit 420 (e.g., charging circuit) and the aforementioned connection interface 430. The working circuit 420 and the aforementioned connection interface 430 are contained in the second outer case 410, and one surface of the aforementioned connection interface 430 is shown outwards from one surface of the second outer case 410. The connection interface 430 includes a magnetic metallic member 440, a first conductive member 450 and a second conductive member 460. The magnetic metallic member 440 is electrically connected to the working circuit 420 via a conductive body 470 (e.g., metal resilient plate). The first conductive member 450 and the second conductive member 460 are fixed on the magnetic metallic member 440, and respectively electrically connected to the working circuit 420. When the working circuit 420 is a charging circuit, the charging circuit includes all components (including hardware and software), which are needed for proceeding charging tasks for receiving, storing and using external electric signals. Since the charging circuit belongs to the conventional technology, the features of the charging circuit will not be described again. The magnetic metallic member is electrically connected to the working circuit. The conductive members are fixed on the magnetic metallic member, and respectively electrically connected to the working circuit.

Thus, since the first metal unit 340 and the second metal unit 360 are oppositely arranged on two ends of the single magnet block 320, magnetic flux lines of the single magnet block 320 can be conducted to the magnetic metallic member 440 of the connection interface 430 via the first metal unit 340 and the second metal unit 360. Therefore, when the first metal unit 340 and the second metal unit 360 can respectively magnetically attract the magnetic metallic member 440, the charging cradle 300 can be magnetically attracted on the portable electronic device 400 fixedly. At this moment, the first conductive pin 370 is separably, but electrically connected to the first conductive member 450, exactly, and the second conductive pin 380 is separably electrically connected to the second conductive member 460, exactly. Thus, the first conductive pin 370 and the second conductive pin 380 enable the working circuit 420 (e.g., charging circuit) electrically connected to the external device. Also, since the first metal unit 340 is electrically connected to the magnetic metallic member 440 and the wire of the cable assembly 210, the first metal unit 340 enables the working circuit 420 (e.g., charging circuit) electrically connected to the external device.

In the embodiment, specifically, the magnetic metallic member 440 is provided with an opening 443 therein. The opening 443 penetrates the magnetic metallic member 440, and the first conductive member 450 and the second conductive member 460 are disposed in the opening 443. However, by filling a single insulating plastic layer 444 in the opening 443, the first conductive member 450 and the second conductive member 460 are physically isolated to each other. Furthermore, the material of the magnetic metallic member 440 is not limited in the disclosure, preferably, the material of the magnetic metallic member can be any kind of metals (e.g., copper and iron) with both high magnetic permeability and low impedance characteristics.

The charging cradle 300 further is provided with an engaging area 311, which is used to correspond to the connection interface 430. The engaging area 311 is defined at a top surface of the first outer case 310. One end of the first conductive pin 370 and one end of the second conductive pin 380 are respectively extended outwards the top surface of the first outer case 310 at the engaging area 311. The other end of the first conductive pin 370 and the other end of the second conductive pin 380 are respectively extended outwards from the block body 321 for electrically connecting to the cable assembly 210. One surface of the first metal unit 340 and one surface of the second metal unit 360 are respectively exposed outwards from the top surface of the first outer case 310 at the engaging area 311 so as to respectively define as a first magnetically attractive surface 341 for directly contacting with the connection interface 430 of the portable electronic device 400.

Similarly, one end of the first conductive member 450 and one end of the second conductive member 460 are respectively electrically connected to the working circuit 420, and the other end of the first conductive member 450 and the other end of the second conductive member 460 are respectively exposed outwards from the magnetic metallic member 440. One surface of the magnetic metallic member 440, which is exposed outwards from a bottom surface of the second outer case 410, is a second magnetically attractive surface 441. Thus, when the charging cradle 300 is engaged with the connection interface 430 of the portable electronic device 400, each of the first magnetically attractive surfaces 341 is in direct contact with the second magnetically attractive surface 441 of the magnetic metallic member 440 to magnetically attract the second magnetically attractive surface 441 thereof. At the same time, the first conductive pin 370 is exactly directly contacted with the first conductive member 450, and the second conductive pin 380 is in precise direct contact with the second conductive member 460.

It is noted that the first conductive pin 370, the second conductive pin 380, the first conductive member 450 and the second conductive member 460 are tubular. For example, each of the first conductive pin 370, the second conductive pin 380, the first conductive member 450 and the second conductive member 460 is a pogo pin. However, the disclosure is not limited thereto, in other embodiments, each of the first conductive pin 370, the second conductive pin 380, the first conductive member 450 and the second conductive member 460 also can be shaped as a pad. For example, each of the first conductive pin 370, the second conductive pin 380, the first conductive member 450 and the second conductive member 460 is a conductive pad.

Moreover, for easily engaging the charging cradle 300 with the connection interface 430 of the portable electronic device 400, each of the aforementioned first metal unit 340 and second metal unit 360 is further provided with a first positioning portion 342 (e.g., convex portion) which is disposed at the corresponding first magnetically attractive surface 341 thereof, and the aforementioned magnetic metallic member 440 is further provided with two second positioning portions 442 (e.g., concave portion) which are disposed at the second magnetically attractive surface 441 thereof. Each of the first positioning portions 342 is matched with one of the second positioning portions 442 in location and shape, thus, when the charging cradle 300 is engaged with the connection interface 430 of the portable electronic device 400, each of the first positioning portions 342 is used to position one of the second positioning portions 442.

Also, in the embodiment, the first conductive member 450, the second conductive member 460 and the magnetic metallic member 440 can be purposely designed as a positive terminal, a negative terminal and a signal transmission terminal (or ground terminal) of the portable electronic device 400 to meet any of restrictions or requirements. Accordingly, the first conductive pin 370, the second conductive pin 380 and the first metal unit 340 are a positive terminal, a negative terminal and a signal transmission terminal (or ground terminal). However, the disclosure is not limited thereto, in other embodiments, the first conductive member 450, the second conductive member 460 and the magnetic metallic member 440 can be altered to be a positive terminal, a signal transmission terminal (or ground terminal) and a negative terminal of the portable electronic device 400.

Figure 4:
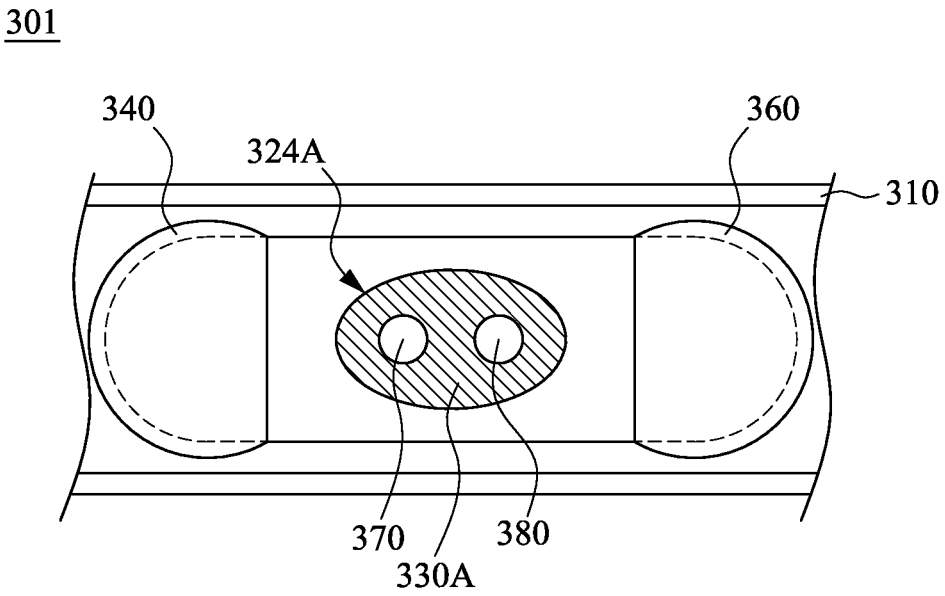
FIG. 4 is a top view of a cradle body according to another embodiment of this disclosure.

Although the first conductive pin 370 and the second conductive pin 380 which are held in the through holes 324 of the single magnet block 320 is described in the aforementioned embodiment of FIG. 2, however, the disclosure is not limited to the aforementioned features, in another embodiment, as shown in FIG. 4, FIG. 4 is a top view of a cradle body 301 according to another embodiment of this disclosure, the single magnet block 320 is provided with a single penetrating hole 324A only. Both of the first conductive pin 370 and the second conductive pin 380 are disposed in the single penetrating hole 324A of the single magnet block 320, however, by filling a single insulating plastic layer 330A in the single penetrating hole 324A, the first conductive pin 370 and the second conductive pin 380 are physically isolated from each other. Thus, comparing to the embodiment of FIG. 1, the number of the penetrating holes in this embodiment can be decreased so as to save processing cost and time.

Figure 5:
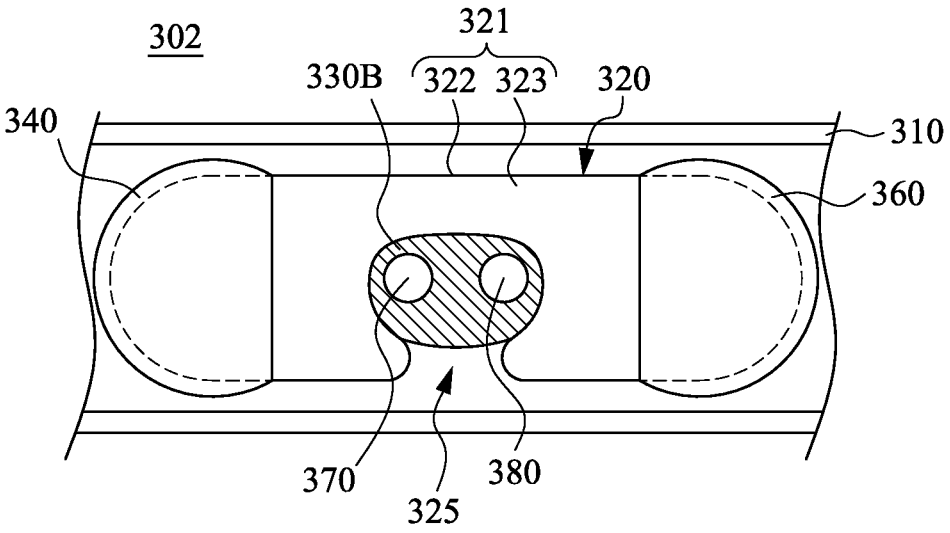
FIG. 5 is a top view of a cradle body according to another embodiment of this disclosure.

Although the first conductive pin 370 and the second conductive pin 380 which are held in the through holes 324 of the single magnet block 320 is described in the aforementioned embodiment of FIG. 2, however, the disclosure is not limited to the aforementioned features, in another embodiment, as shown in FIG. 5, FIG. 5 is a top view of a cradle body 302 according to another embodiment of this disclosure, the single magnet block 321 is provided with a single indentation 325 only. Both of the first conductive pin 370 and the second conductive pin 380 are disposed in the single indentation 325 of the single magnet block 321, however, by filling a single insulating plastic layer 330B in the single indentation 325, the first conductive pin 370 and the second conductive pin 380 are physically isolated from each other. Specifically, the single indentation 325 is formed on the block body 321 of the single magnet block 321, penetrates through the first surface 322 and the second surfaces 323 of the block body 321. Thus, the inner surfaces of the single indentation 325 are respectively connected to the first surface 322 and the second surfaces 323 of the block body 321. Thus, comparing to the embodiment of FIG. 1, both of the first conductive pin 370 and the second conductive pin 380 can transversely move into the single indentation 325 so as to save processing cost and time.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A cable set comprising:

a cable assembly; and a connector comprising:

a single magnet block comprising:

a block body comprising at least one first surface, and two second surfaces which are opposite to each other, wherein the at least one first surface is disposed between the second surfaces and surrounds and connects to the second surfaces; and at least one through hole penetrating the second surfaces of the block body, wherein an inner surface of the at least one through hole respectively connects to the second surfaces;

a first metal unit fixed to and in contact with outer surfaces of the single magnet block, electrically connected to the cable assembly, and used for attracting and electrically connecting to a portable electronic device; and two conductive pins respectively penetrating through the single magnet block, respectively electrically connected to the cable assembly, and used for electrically connecting to the portable electronic device wherein the conductive pins are respectively disposed in the at least one through hole.

2. The cable set of claim 1, further comprising:

a second metal unit arranged oppositely to the first metal unit, and fixed to and in contact with the outer surfaces of the single magnet block for attracting the portable electronic device.

3. The cable set of claim 1, wherein one surface of the first metal unit is a magnetically attractive surface, and the magnetically attractive surface is used for directly contacting with the portable electronic device, wherein the first metal unit further comprises at least one positioning portion disposed on the magnetically attractive surface for positioning the portable electronic device.

4. The cable set of claim 1, further comprising:

at least one insulating plastic layer sandwiched between the single magnet block and one of the conductive pins.

5. The cable set of claim 1, wherein the first metal unit comprises:

a U-shaped clamping element fixed to clamp one end of the single magnet block; and an accommodation recess formed on the U-shaped clamping element for receiving the end of the single magnet block.

6. An electronic product comprising:

a portable electronic device comprising:

a working circuit; and a connection interface comprising:

a magnetic metallic member electrically connected to the working circuit; and two conductive members fixed on the magnetic metallic member, and respectively electrically connected to the working circuit; and a cable set comprising:

a cable assembly for electrically connected to an external device; and a connector comprising:

a single magnet block;

a first metal unit fixed to and in contact with outer surfaces of the single magnet block, electrically connected to the cable assembly, separably magnetically-attracted the magnetic metallic member, and electrically connected to the magnetic metallic member; and two conductive pins respectively penetrating through the single magnet block, respectively electrically connected to the cable assembly, and separably electrically connecting to the conductive members, respectively.

7. The electronic product of claim 6, wherein the conductive members and the magnetic metallic member respectively are a positive terminal, a negative terminal and a signal transmission terminal of the portable electronic device.

8. The electronic product of claim 6, wherein the cable set further comprises:

a second metal unit arranged oppositely to the first metal unit, fixed to and in contact with the outer surfaces of the single magnet block, and separably magnetically-attracted the magnetic metallic member.

9. The electronic product of claim 6, wherein one surface of the first metal unit is a first magnetically attractive surface, one surface of the magnetic metallic member is a second magnetically attractive surface, and the first magnetically attractive surface directly contacts the second magnetically attractive surface.

10. The electronic product of claim 9, wherein the first metal unit further comprises at least one first positioning portion, the first positioning portion is disposed on the first magnetically attractive surface, the magnetic metallic member comprises at least one second positioning portion, and the second positioning portion is disposed on the second magnetically attractive surface, wherein the first positioning portion matches the second positioning portion for positioning the second positioning portion.

11. The electronic product of claim 6, wherein the single magnet block comprises:

a block body comprising at least one first surface and two second surfaces which are opposite to each other, wherein the at least one first surface is disposed between the second surfaces, and the at least one first surface surrounds and connects to the second surfaces; and at least one through hole penetrating through the second surfaces of the block body, wherein an inner surface of the at least one through hole respectively connects to the second surfaces, and the conductive pins are respectively disposed in the at least one through hole.

12. The electronic product of claim 6, wherein the single magnet block comprises:

a block body comprising at least one first surface and two second surfaces which are opposite to each other, wherein the at least one first surface is disposed between the second surfaces, and the at least one first surface surrounds and connects to the second surfaces; and at least one indentation formed on the block body, penetrating through the at least one first surface and the second surfaces of the block body, wherein an inner surface of the at least one indentation respectively connects to the at least one first surface and the second surfaces of the block body, and the conductive pins are respectively disposed in the at least one indentation.

13. The electronic product of claim 6, wherein the cable set further comprises:

at least one insulating plastic layer sandwiched between the single magnet block and one of the conductive pins.

14. The electronic product of claim 6, wherein the first metal unit comprises:

a U-shaped clamping element fixed to clamp one end of the single magnet block; and an accommodation recess formed on the U-shaped clamping element for receiving the end of the single magnet block.

15. The electronic product of claim 6, wherein each of the conductive pins is a pogo pin or a conductive pad.

16. A cable set comprising:

a cable assembly; and a connector comprising:

a single magnet block comprising:

a block body comprising at least one first surface and two second surfaces that are opposite to each other, wherein the at least one first surface is disposed between the second surfaces, and the at least one first surface surrounds and connects to the second surfaces; and at least one indentation formed on the block body, penetrating through the at least one first surface and the second surfaces of the block body, wherein an inner surface of the at least one indentation respectively connects to the at least one first surface and the second surfaces of the block body;

a first metal unit fixed to and in contact with outer surfaces of the single magnet block, electrically connected to the cable assembly, and used for attracting and electrically connecting to a portable electronic device, wherein the conductive pins are respectively disposed in the at least one indentation.

17. The cable set of claim 16, further comprising:

a second metal unit arranged oppositely to the first metal unit, and fixed and contacted with the outer surfaces of the single magnet block for attracting the portable electronic device.

18. The cable set of claim 16, wherein one surface of the first metal unit is a magnetically attractive surface, and the magnetically attractive surface is used for directly contacting with the portable electronic device, and wherein the first metal unit further comprises at least one positioning portion disposed on the magnetically attractive surface for positioning the portable electronic device.

19. The cable set of claim 16, further comprising:

at least one insulating plastic layer sandwiched between the single magnet block and one of the conductive pins.

20. The cable set of claim 16, wherein the first metal unit comprises:

a U-shaped clamping element fixed to clamp one end of the single magnet block; and an accommodation recess formed on the U-shaped clamping element for receiving the end of the single magnet block.

* * * * *